United States Patent [19]

Rule

[11] 4,316,287

[45] Feb. 23, 1982

[54] CHILD'S LOUNGING GARMENT

[76] Inventor: Barbara A. Rule, 4416 Dunn, Lawrence, Ind. 46226

[21] Appl. No.: 156,502

[22] Filed: Jun. 4, 1980

[51] Int. Cl.[3] ..... A47G 9/08; A41D 11/00

[52] U.S. Cl. ..... 2/69.5; 5/419; 5/413

[58] Field of Search ..... 5/413, 414, 415, 416, 5/419, 420; 2/69.5, 83

[56] References Cited

U.S. PATENT DOCUMENTS

| | | | |
|---|---|---|---|
| 3,176,315 | 4/1965 | Freund | 5/417 |
| 3,579,675 | 5/1971 | Scmeer | 5/416 |
| 3,689,947 | 9/1972 | Wolf | 5/419 |
| 4,033,001 | 7/1977 | Kern | 2/83 |
| 4,125,910 | 4/1978 | Nicholai | 2/69.5 |
| 4,194,254 | 3/1980 | Torrez | 5/420 |
| 4,236,263 | 12/1980 | Allee | 5/413 |

FOREIGN PATENT DOCUMENTS

| | | | |
|---|---|---|---|
| 1424516 | 2/1976 | United Kingdom | 5/416 |

OTHER PUBLICATIONS

"Furry Dog", From p. 45 of the 1979 Edition of the Joan Cook Catalog, Available from Joan Cook, 3200 S.E. 14th Ave., Ft. Lauderdale, FL., 33316.

*Primary Examiner*—Alexander Grosz

*Attorney, Agent, or Firm*—Woodard, Weikart, Emhardt & Naughton

[57] ABSTRACT

Disclosed is a lounging garment adapted for children's entertainment and use in, for example, viewing television comprising a fabric envelope of fanciful contour having arm portions and a slit at the junction of the head and body portions with head portion providing a cushion for the head of the wearer which extends through the slit when the wearer has entered the envelope.

2 Claims, 6 Drawing Figures

CHILD'S LOUNGING GARMENT

BACKGROUND OF THE INVENTION

The tendency for children to watch television for prolonged periods is well documented. With current energy use restrictions and the pressure to lower thermostat settings because of high fuel cost, providing a comfortable, warm lounging garment for children has become something more than a mere incidental need. For children under six, the enjoyment, and, allegedly, the value of educational television programs can be enhanced by injecting an element of participation or costuming into the viewing environment.

The present invention provides a child's lounging garment which is shaped and decorated to resemble a fanciful figure, as specifically disclosed herein, a panda. However, other fanciful figures, such as well-known cartoon characters, or children's story characters might also form the contour and decorative theme of the garment. The garment is characterized by the utilization of the head portion of the garment as a cushioning pillow with a slit at the head-body junction permitting the wearer's head to extend through and overlie the cushioning pillow which forms the face of the fanciful figure. The arm portions of the garment are provided with slits or openings through which the hands or arms of the wearer may be extended for manipulation of objects such as edibles.

DESCRIPTION OF THE PREFERRED EMBODIMENT

Figure 1:
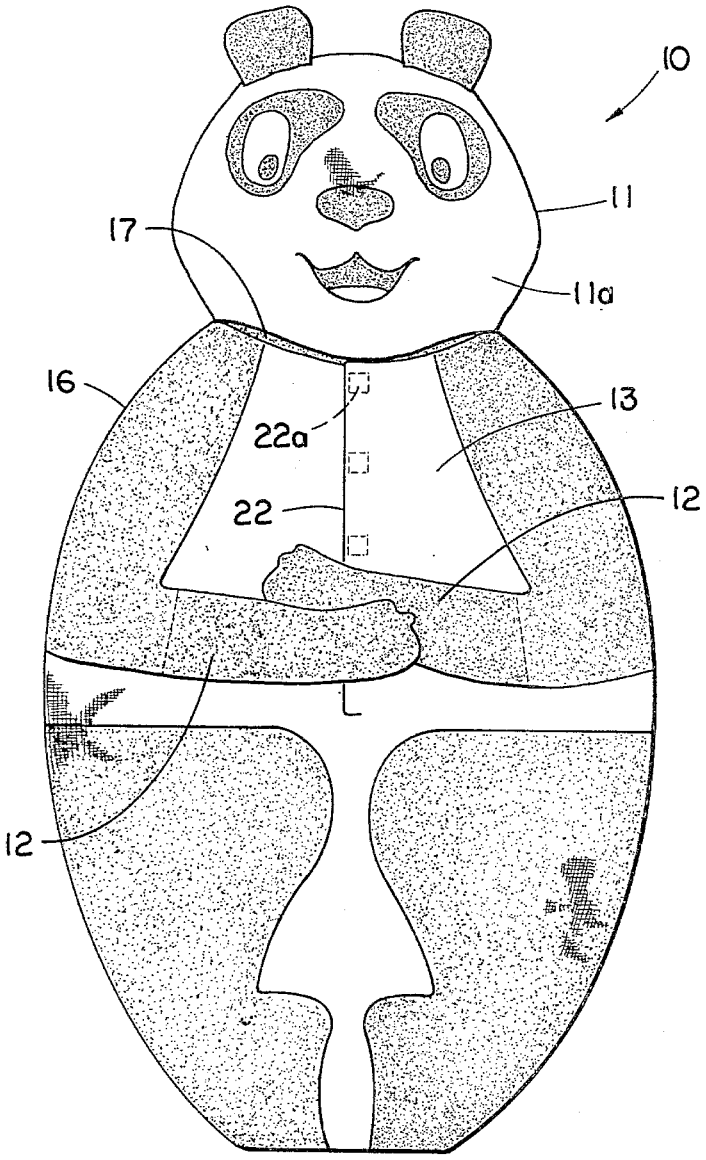
FIG. 1 is a front view of a lounging garment embodying the present invention.
Figure 2:
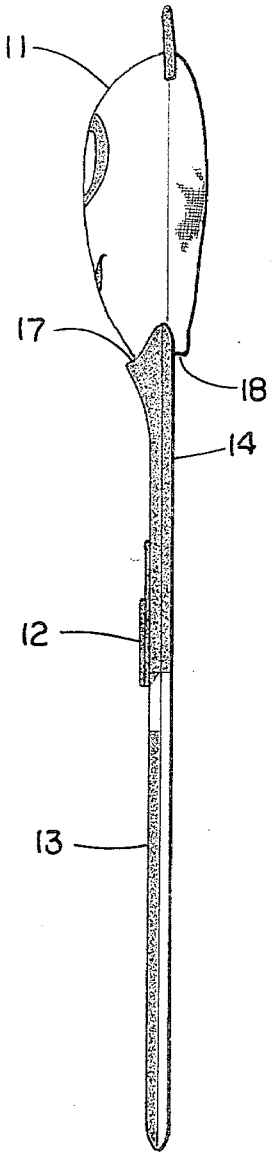
FIG. 2 is a side view thereof.
Figure 3:
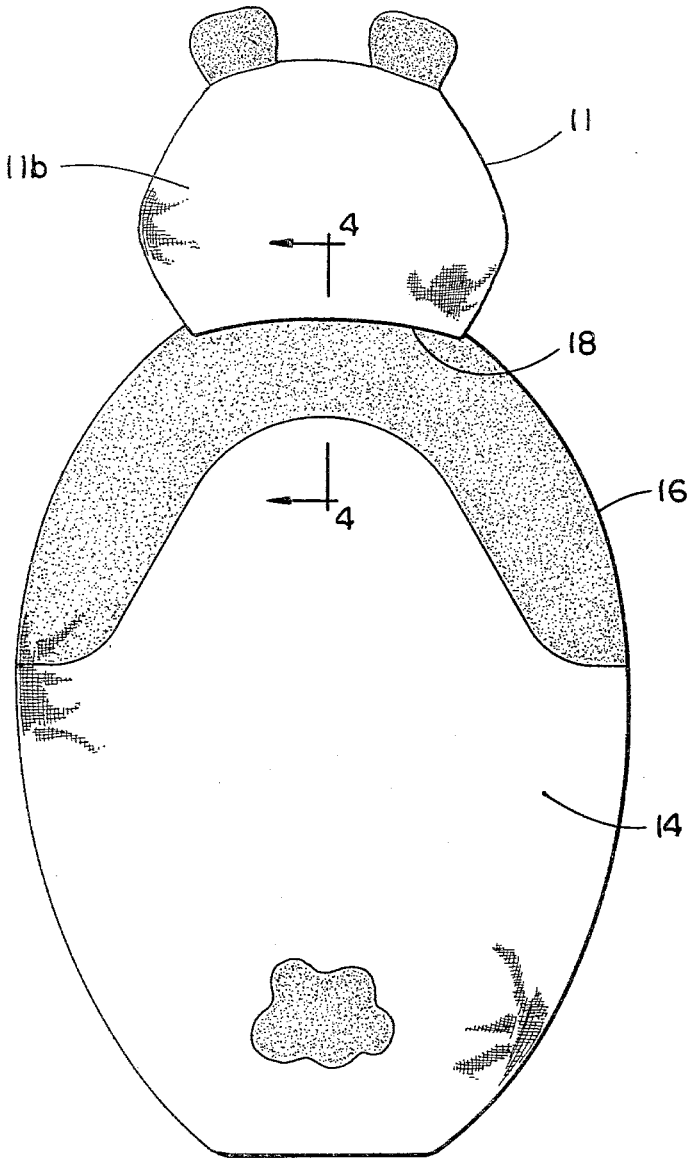
FIG. 3 is a rear view thereof.

Referring initially to FIGS. 1–3, the invention is embodied in a garment shaped and decorated to resemble a panda and comprises a fabric envelope. The envelope includes a body portion 10, a head portion 11 and extending arm portions 12 (shown folded over the body portion in FIG. 1). While the body portion may be fabricated in any suitable fashion, it is here shown as formed by front and rear panels 13 and 14 (rear panel 14 being shown in FIG. 3) joined by sewing at their marginal edges 16. The front and rear panels may be formed by joining sub-panels of black and white fabric shaped to provide the characteristic panda-like color markings. While any suitable fabric could be used to form the panels, a soft acrylic pile fabric is preferred.

Figure 4:
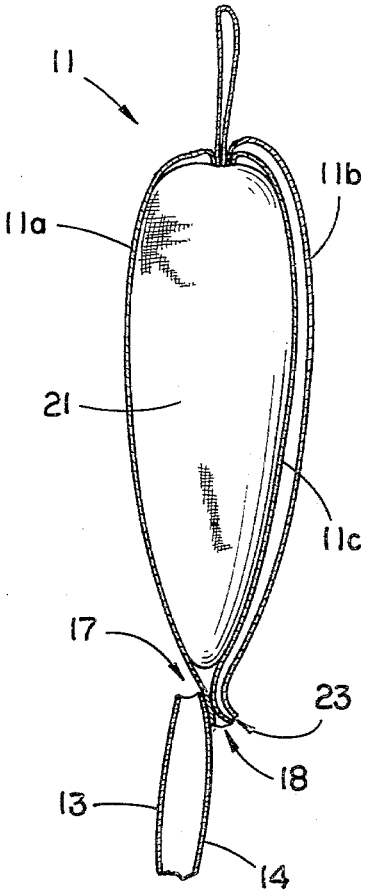
FIG. 4 fragmentary sectional view taken generally along line 4—4 of FIG. 3.

The heat portion 11 is also formed by a front and rear panel, 11*a* and 11*b*, joined along their margins. As may best be seen in FIG. 4, the front panel 11*a* is joined to rear panel 14 leaving a front slit or opening 17 at the junction of the body and head portions. As may best be seen in FIG. 4, a sub-panel 11*c*, which need not be formed of pile fabric, is interposed adjacent to and generally coextensive with the panel 11*b*. The pocket or space between front panel 11*a* and sub-panel 11*c* receives cushioning material 21. A rear slit (18 in FIG. 4), normally closed by hook and pile fasteners, such as those sold under the trademark Velcro, or similar fasteners, can be opened to permit removal of the cushioning material when the garment is to be laundered. The space or pocket between sub-panel 11*c* and rear panel 11*b* accommodates the lower portion of the garment after folding as will subsequently be described, entry of the folded material being made through the opening 23 indicated in FIG. 4.

Figure 5:
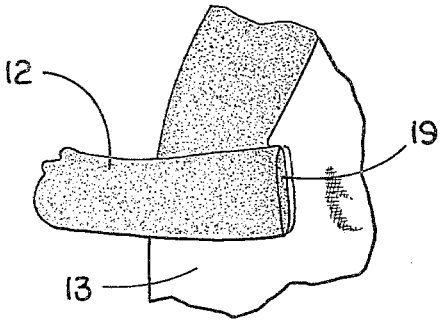
FIG. 5 is a fragmentary front view showing the arm portion in a different position from that of FIG. 1.

As may best be seen in FIG. 1, the garment may be entered by the wearer through the vertical slit 22 which intersects front horizontal slit 17. The vertical slit is bounded by overlapping tabs and may be closed by buttons, a zipper or, as here shown, by hook and pile fasteners, such as those sold under the trademark Velcro and identified at 22*a*. As shown in FIG. 5, the arm portions when folded outwardly from their position of FIG. 1 reveal a slit 19 communicating with the interior of the body portion and permit the wearer to withdraw his arm and hand from the arm portion and extend them through slit 19, freeing the hands and arms of the wearer for manipulation of objects, such as edibles.

Figure 6:
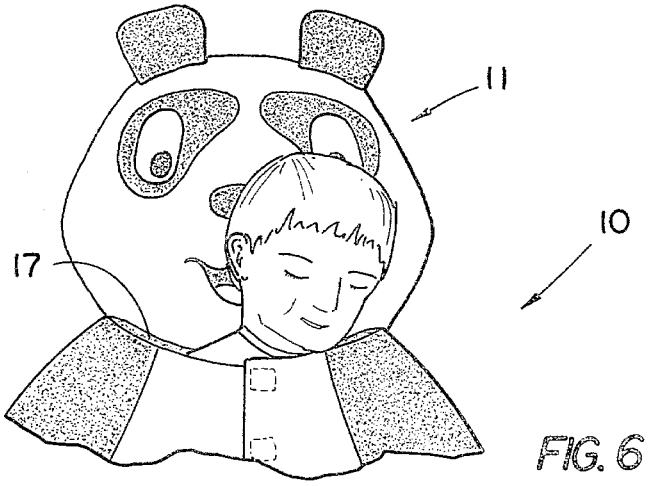
FIG. 6 is a fragmentary, front view illustrating the lounging garment in use.

The garment in use is shown in FIG. 6. The head of the wearer extends from slit 17, overlies the portion 11 and is cushioned by it when the wearer is in a reclining or semi-reclining position. The garment is formed to be loose and non-confining for the wearer and provides a warm, comfortable covering for a child while reading or viewing television.

For storage or transport the garment may be folded to a relatively small volume by folding the arms 12 to their position of FIG. 1 and then folding the convex marginal areas of the body panels 14 and 16 forwardly on generally vertical fold lines intersecting the ends of the rectilinear base line. The generally vertical, rectangularly contoured folded body portion may then be folded upon itself upwardly from the rectilinear base line and the generally rectangular fold stack resulting may be inserted through slit 23 (FIG. 4) into the space between head panels 11*b* and 11*c*.

While the invention has been illustrated and described in detail in the drawings and foregoing description, the same is considered to be illustrative and not restrictive in character, it being understood that only the presently preferred embodiment has been shown and described and that all changes and modifications that come within the spirit of the invention are desired to be protected.

I claim:

1. A child's lounging garment comprising a fabric envelope shaped to resemble a fanciful figure, said envelope having a central body portion and side extending arm portions to accommodate the wearer's arms, a head portion extending from the top margin of said body portion of the envelope and containing cushioning material to adapt the head portion for use as a headrest pillow, a transverse slit in the envelope front adjacent the junction of the head portion with the envelope to permit the wearer's head to extend to the exterior of the envelope and to overlie said head portion when the wearer is reclining, said head portion including an integral storage pocket to accommodate the folded body portion of the garment, said head portion of said envelope being formed by a front panel a rear panel and an intermediate sub panel with said cushioning material interposed between said front and intermediate panels, said head portion being provided with a first opening between said front panel and said intermediate panel permitting withdrawal of said cushioning material for cleaning, and a second opening between said intermediate panel and said rear panel providing entry to said storage pocket accommodating the folded body portion of the garment during storage or transport.

2. A lounging garment as claimed in claim 1 having a vertical closeable slit in the front face of said envelope intersecting said transverse slit to permit the wearer's entry into said envelope.

* * * * *